US005769327A

United States Patent [19]

Kure et al.

[11] Patent Number: 5,769,327

[45] Date of Patent: Jun. 23, 1998

[54] NOZZLE FOR SPREADING WATER FOG

[75] Inventors: Bo Kure, Göteborg; Anders Kjellberg, Onsala, both of Sweden

[73] Assignee: Kure Fastighets & Forvaltnings AB, Gothenburg, Sweden

[21] Appl. No.: 666,554

[22] PCT Filed: Jan. 5, 1995

[86] PCT No.: PCT/SE95/00007

§ 371 Date: Sep. 6, 1996

§ 102(e) Date: Sep. 6, 1996

[87] PCT Pub. No.: WO95/18651

PCT Pub. Date: Jul. 13, 1995

[30] Foreign Application Priority Data

Jan. 5, 1994 [SE] Sweden ..... 9400028

[51] Int. Cl.[6] ..... B05B 1/26

[52] U.S. Cl. ..... 239/543; 239/548

[58] Field of Search ..... 239/543, 544, 239/560, 548

[56] References Cited

U.S. PATENT DOCUMENTS

| | | | |
|---|---|---|---|
| 2,302,021 | 11/1942 | Freeman | 239/543 |
| 2,499,092 | 2/1950 | Burnham | 239/544 |
| 2,647,800 | 8/1953 | Burnham | 239/543 |
| 3,380,664 | 4/1968 | Miller et al. | 239/460 X |
| 3,384,307 | 5/1968 | Moen | 239/460 |
| 3,403,860 | 10/1968 | Shames et al. | 239/460 |
| 3,504,893 | 4/1970 | Susuki et al. | 239/488 |
| 3,547,353 | 12/1970 | Pecka | 239/460 |
| 3,617,002 | 11/1971 | Symmons | 239/460 |
| 4,129,257 | 12/1978 | Eggert | 239/460 X |
| 5,518,183 | 5/1996 | Waldrum | 239/460 |

FOREIGN PATENT DOCUMENTS

| | | |
|---|---|---|
| 159737 | 11/1981 | Denmark . |
| 571686 | 5/1924 | France . |
| 1625235 | 3/1972 | Germany . |
| 9220454 | 11/1992 | WIPO . |

*Primary Examiner*—Lesley D. Morris
*Attorney, Agent, or Firm*—Oppedahl & Larson

[57] ABSTRACT

A nozzle for generating and distributing water fog through discharge orifices (18), for example for use for extinguishing fires fighting equipment. At least two of the channels converge and collide at a point outside the nozzle, which comprises an attachment (10) for connection with a water conduit. The attachment is provided with a support surface (16; 19) for a nozzle head (12; 21, 24). The nozzle head (12; 21, 24) is provided with at least one support surface (17; 22) cooperating with the support surface (16; 19) of the attachment. The discharge orifices (18) are located at the support surfaces (16, 17, 19, 22) between the head (12, 21; 24) and the attachment (10).

16 Claims, 1 Drawing Sheet

NOZZLE FOR SPREADING WATER FOG

FIELD OF THE INVENTION

The present, invention relates to a nozzle for generating and distributing water fog through discharge orifices, of which at least two converge and collide at a point outside the nozzle, for example for extinguishing fires, and comprising an attachment for connection with a water conduit, which attachment is provided with a support surface for a nozzle head.

BACKGROUND OF THE INVENTION

Sprinklers are the collective denomination for devices used for fighting fires, when a liquid is discharged automatically in order to overcome fire in a room. It is distinguished between conventional sprinklers and high pressure sprinklers. Previously, only conventional sprinklers were used. These extinguished the fire but at the same time caused immense water damages because of the large amount of water which was consumed during extinction. The consequence was even more disastrous for vessels which capsized because of the reduced stability caused by the increased amount of water. During a later period one went over to fit up rooms with non-inflammable material. These non-inflammable materials did not start to burn but instead generated toxic gas. In recent years, high pressure sprinkler systems have been developed. These have proven to be effective when fighting fires in rooms since only a limited amount of water is used. There are a number of prior art high pressure sprinkler systems with different nozzle designs.

There are a number of problems with these prior art nozzles. One known nozzle is composed of about twenty-two details. This leads to high costs for manufacturing and assembly. The discharge openings in the nozzle decides the drop size of the liquid and the flow. The spreading of fog is depending upon this drop size and this flow. The ability to penetrate into the fire is also depending upon the drop size and the flow.

It is associated with very high costs to alter the size of the nozzles. This implies that the size of the nozzles is seldom changed. Usually, a number of alternative nozzle sizes are contemplated. The possibility to influence conditions depending upon which type of fire which might be encountered, is therefore limited for these prior art nozzles. The loss of energy is high because of the shape of the discharge openings in the nozzles. The exit velocity is only 60 m/s at 200 bar. With other words, the design of the nozzles cause limitations concerning the volume of the fog spreading, the area, speed and precision. So far, there have been two alternatives. The first alternative results in an inferior spreading of the liquid, but in an excellent drop size. The other alternative results in an excellent spreading of the liquid, but in an inferior drop size.

It is known that if two or more water jets with very high speed is brought to collide in the air, these water jets will disintegrate into a fog which can move rapidly away from the nozzle. However, prior art high pressure nozzles are designed comparatively clumsy and are very expensive to produce, because of the high demands for precision in the design of the jet orifices. Thus, the cost for installation of high pressure sprinkler systems have been high.

TECHNICAL PROBLEM

The present invention is aimed at solving the above mentioned problems at prior art high pressure nozzles.

THE SOLUTION

For this object, the invention is characterized in that the nozzle head is provided with at least one support surface cooperating with the support surface of the attachment, and that the discharge orifices are located at the support surfaces between the head and the attachment.

The high pressure nozzle according to the present invention is designed so that a small amount of water, 1–25 l/minute, at a high pressure of 15–250 bar, is disintegrated to a fog. The fog exits the nozzle at a very high velocity, 50–200 m/s (200 m/s at 200 bar) and with a large impact force (as compared with known nozzles 60 m/s at 200 bar). The effective range of the nozzle is therefore about 10 times longer than the corresponding for prior art nozzles.

By changing the size of the fog generating channels, it is possible in a simple way to increase or reduce the flow of water through the nozzle and thereby achieving exactly the desired effect, depending upon which type of fire which is likely to be fought. By increasing or reducing the intersecting angles of the orifice channels, it is possible to adapt the spreading of the fog, drop size and exit velocity and thereby accomplishing exactly the desired effect, depending upon which type of fire which is likely to be fought. For example, for fire in cabins, the spreading should be as large as possible and the size of the drops as small as possible. For oil fires, the spreading should be aimed and the drop size should be medium and have a large velocity.

The high pressure nozzle according to the present invention has only five details (as compared with prior art nozzles having about twenty-two details). The cost of manufacture will therefore be considerably less and the installation work will be simplified.

BRIEF DESCRIPTION OF THE DRAWINGS

A few embodiments of the invention will now be described here below with reference to the attached drawings, in which.

DESCRIPTION OF A PREFERRED EMBODIMENT

Figure 1:
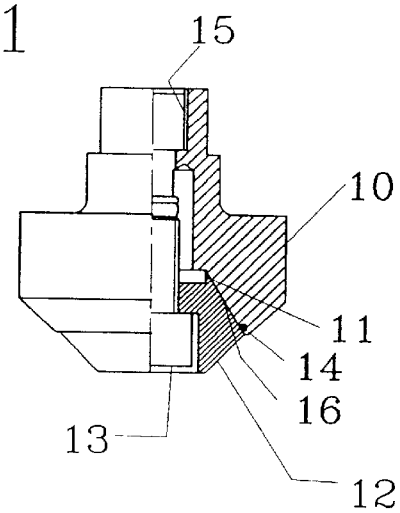
FIG. 1 shows a high pressure nozzle according to a first embodiment of the invention in a side view, partly in section.
Figure 2:
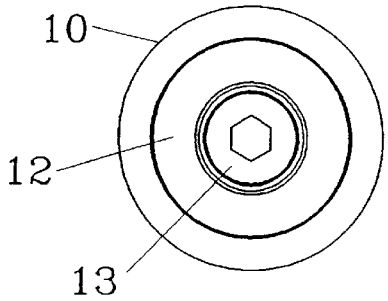
FIG. 2 is an end view of the nozzle according to FIG. 1.
Figure 3:
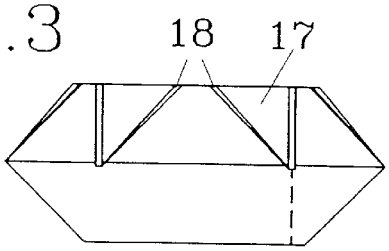
FIG. 3 shows in a side view a nozzle head which is comprised in the nozzle according to FIG. 1 and 2.
Figure 4:
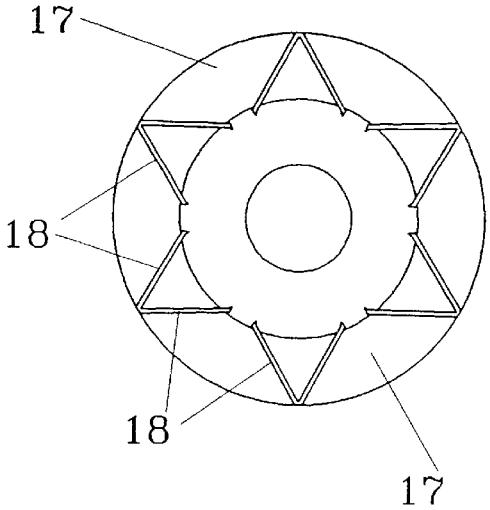
FIG. 4 is an end view of said head.

The high pressure nozzle according to FIG. 1–4 is consists of an attachment 10, a filter 11, a nozzle head 12, a bolt 13 and an O-ring seal 14.

The attachment 10 is provided with an inner screw thread at 15 which enables installation of the high pressure nozzle at a not shown connection for a pressure water mains, for supply of water having a pressure of for example 200 bar. The attachment is designed to lead water into the filter space. It is also provided with a conically diverging, circular support surface 16 for the nozzle head 12. The support surface 16 is provided with a groove which runs along the radially outer edge for the O-ring 14.

The nozzle head 12 has in this embodiment the shape of a double cone which is filled and which has both its tips cut off. One of the two mantle surfaces 17 of the cone forms in its mounted state a support surface against the support surface 16 of the attachment. One of these two surfaces is according to the invention provided with narrow milled grooves or channels 18, which in the two illustrated embodiments are located in the support surface 17 of the head. Alternatively, the channels 18 may be located in the support surface 16 of the attachment. In that case, the O-ring 14 is placed in slot around the support surface 17 of the head.

Thus, the channels 18 are in the embodiment according to FIG. 1–4 milled into the support surface 17. These channels guide water jets in pairs, so that each pair of liquid jets are caused to collide at a point immediately outside the fog generator. In this way, a negative pressure is created which draws air in between the water jets. The air is compressed at the point of collision where the two water jets are meeting. Because the speed of collision is large, and the drawn air is compressed, the water jet is disintegrated to a fine fog with a very large exit velocity (large impact). The point of collision is determined with exact precision by the mutual angle of the channels.

The channels 18 are preferably straight and have a rectangular cross section. The size of the channels and the number influences the water flow through the nozzle. The point angle between two cooperating channels have a large importance for the creation of fog. The spreading of the fog, drop size and exit velocity (impact) can be adapted accurately by increasing or reducing the point angle.

The O-ring 14 is intended to form a seal between the support and contact surfaces 16, 17 and also provides turbulence in the water shortly before the outlet orifices of the channels. The turbulent movement makes the fog spread more rapidly in the radial directions.

Figure 5:
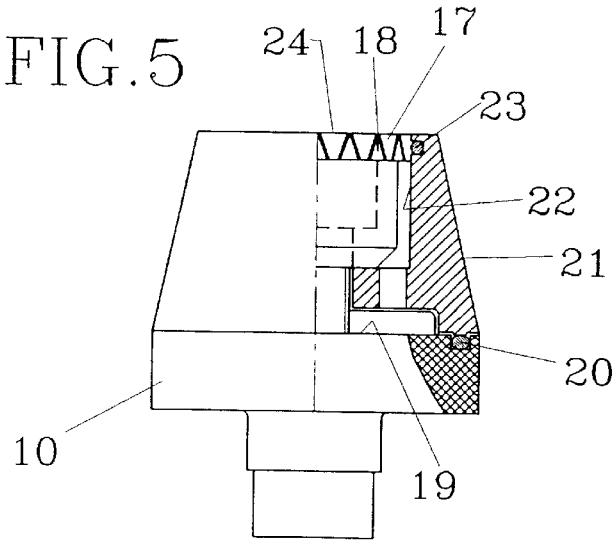
FIG. 5 shows in a corresponding way as FIG. 1 a second embodiment of the invention.

FIG. 5 shows a variant of the high pressure nozzle according to the invention. This variant can for example be used as a hand operated nozzle for extinguishing fires. The attachment 10 is provided with a flat, circular support surface 19 with an O-ring seal 20 for a intermediate part 21 which is provided with radially directed, in pairs converging channels 18, in a corresponding way as in the previous embodiment, in the contact surface to the support surface 17.

The intermediate part 21 in its turn, is provided with a coaxial support surface 22 with an O-ring seal 23 for a cylindrically formed inner nozzle head 24 which is provided with axially directed, in pairs converging channels 18, in a corresponding way as at the previous embodiment, in the contact surface to the support surface 22.

Thus, the nozzle according to this embodiment adapted to deliver one jet of fog which is directed axially for maximum kinetic energy in the axial direction, and also a fog shield expanding in the radial direction, which shield protects the operator of the nozzle from heat radiation.

The invention is not limited to the above described embodiment, but several variations are possible within the scope of the accompanying claims. For example, the nozzle according to the invention can be used for other purposes than extinguishing fires. The channels 18 may be arranged in surfaces with optional angle in relation to the longitudinal axis of the nozzle. The channels do not have to be arranged in a body which is rotation symmetrical, but this body can be oval or angular. The cross section of the channels 18 can be round or angular.

We claim:

1. A nozzle for generating and distributing a water fog comprising (a) a head member having a first support surface (b) an attachment member, said attachment member comprising means for attaching the attachment member to a water conduit and a hollow body member, said hollow body member being open at a first end to receive water from a water conduit to which the attachment member is attached, and having a second support surface at a second end for receiving the head member, whereby the head member and the attachment member cooperate to control discharge of water from the nozzle, wherein the nozzle has at least two convergent discharge orifices formed between and defined by the contacting first and second support surfaces and wherein water discharged through the orifices collides at a point outside the nozzle determined by the orientation of the orifices.

2. The nozzle according to claim 1, wherein the discharge orifices comprise at least two grooves formed in the first support surface.

3. The nozzle according to claim 2, further comprising an O-ring disposed in the space between the first support surface and the second support surface for introducing turbulence to water passing through the discharge orifices.

4. The nozzle according to claim 1, further comprising an O-ring disposed in the space between the first support surface and the second support surface for introducing turbulence to water passing through the discharge orifices.

5. The nozzle according to claim 1, wherein the attachment member is formed from two pieces, a base portion including the means for attaching the attachment member and a hollow portion having the second support surface on an interior surface thereof, and wherein the head member is received within the hollow portion.

6. The nozzle according to claim 5, wherein the discharge orifices comprise at least two grooves formed in the first support surface.

7. The nozzle according to claim 5, further comprising an O-ring disposed in the space between the first support surface and the second support surface for introducing turbulence to water passing through the discharge orifices.

8. The nozzle according to claim 5, wherein the hollow portion is cylindrical and provides a cylindrical second support surface which cooperates with the first support surface.

9. The nozzle according to claim 8, wherein the first support surface is coaxial with the longitudinal axis of the nozzle and wherein the discharge orifices are axially converging.

10. The nozzle according to claim 9, wherein the discharge orifices comprise at least two grooves formed in the first support surface.

11. The nozzle according to claim 9, further comprising an O-ring disposed in the space between the first support surface and the second support surface for introducing turbulence to water passing through the discharge orifices.

12. The nozzle according to claim 8, wherein the discharge orifices comprise at least two grooves formed in the first support surface.

13. The nozzle according to claim 8, further comprising an O-ring disposed in the space between the first support surface and the second support surface for introducing turbulence to water passing through the discharge orifices.

14. The nozzle according to claim 5, wherein the first support surface is coaxial with the longitudinal axis of the nozzle and wherein the discharge orifices are axially converging.

15. The nozzle according to claim 14, wherein the discharge orifices comprise at least two grooves formed in the first support surface.

16. The nozzle according to claim 14, further comprising an O-ring disposed in the space between the first support surface and the second support surface for introducing turbulence to water passing through the discharge orifices.

* * * * *